United States Patent [19]

Schmitz

[11] 4,236,643

[45] Dec. 2, 1980

[54] VEHICLE STABILIZER ASSEMBLY

[75] Inventor: Floyd A. Schmitz, Burlington, Iowa

[73] Assignee: J. I. Case Company, Racine, Wis.

[21] Appl. No.: 942,326

[22] Filed: Sep. 14, 1978

[51] Int. Cl.[3] ..... B60S 9/00

[52] U.S. Cl. .....414/694; 212/189; 280/764

[58] Field of Search ..... 212/145; 414/694, 697; 280/765, 764, 763; 292/304

[56] References Cited

U.S. PATENT DOCUMENTS

| | | | |
|---|---|---|---|
| 2,449,661 | 12/1949 | Taylor | 212/145 |
| 3,365,214 | 1/1968 | Garnett | 212/145 X |
| 3,951,281 | 4/1976 | Parquet | 414/697 |
| 4,132,324 | 1/1979 | Long | 212/145 X |

*Primary Examiner*—Stephen G. Kunin
*Assistant Examiner*—Lawrence E. Williams
*Attorney, Agent, or Firm*—Dressler, Goldsmith, Shore, Sutker & Milnamow, Ltd.

[57] ABSTRACT

A stabilizer assembly for a vehicle with increased lift capability and lateral support, without sacrificing any degree of uprightness during transport, is provided by trunnion mounting the cylinder of a cylinder and piston rod assembly to the frame. An automatic mechanical latching mechansim for securing the stabilizer assembly in an upright position during transport is also provided.

9 Claims, 5 Drawing Figures

VEHICLE STABILIZER ASSEMBLY

BACKGROUND OF THE INVENTION

This invention relates to construction vehicles of the type having a material handling implement, and more particularly, to an improved stabilizer arm assembly for laterally supporting the vehicle and raising the wheels of the vehicle off the ground during operation of the material handling implement.

Many types of construction vehicles have stabilizer arms, or outriggers which extend downwardly and outwardly from the frame sides during operation of their material handling implements to engage the ground to laterally support the vehicle against tipping, and to anchor the vehicle to the ground by raising the wheels at the end of the vehicle having the material handling implement off the ground. For example, in a vehicle having a material handling implement, such as a backhoe, operatively connected to the rear end of the vehicle, a stabilizer arm is positioned generally adjacent and rearwardly of each of the rear wheels. It has also been found advantageous under some working conditions to mount stabilizer arms at the front end of the vehicle. U.S. Pat. Nos. 3,376,984; 3,951,281; 3,955,695 and 4,026,428 disclose some typical arrangements of stabilizer arms.

A stabilizer arm typically has one end pivotally connected to the frame about a fixed stabilizer pivot point for movement between a ground engaging support position extending laterally outward of the wheel and a generally upright, transport or storage position. To move the stabilizer arm between support and transport positions, and to apply a downward force on the stabilizer arm when in the support position to lift the vehicle off the ground, various power sources can be used. A common power source used for construction vehicles is a fluid ram, such as a hydraulic cylinder and piston rod assembly. Usually, one end of the fluid ram is pivotally mounted to the frame of the vehicle about a fixed pivot axis and the other end operatively connected to the stabilizer arm.

The lifting capability of a stabilizer assembly in a ground engaging position is proportional to the distance between the fixed stabilizer pivot point and the fluid ram. This distance, or moment arm, is limited in prior art units having end mounted fluid rams so as to tuck the stabilizer arms close to the frame sides in a generally upright position for transport.

It is therefore desirable to provide an improved stabilizer assembly which overcomes this limitation of the moment arm in prior art assemblies without sacrificing any degree of transport position uprightness.

SUMMARY OF THE INVENTION

In accordance with the present invention an improved stabilizer assembly with increased lift capability and lateral support, as well as a more upright transport position than prior art assemblies, is provided by trunnion mounting the cylinder of a cylinder and piston rod assembly to the frame.

A pair of generally vertical and generally parallel plates spaced apart from each other are rigidly secured, such as by welding, to the frame and extend outwardly therefrom to form bracket means. A stabilizer arm has a fixed end pivotally mounted about a fixed stabilizer pivot point on each of the plates for movement of the stabilizer arm between a ground engaging support position and a generally upright transport position. The opposite end of the stabilizer arm, sometimes referred to as the "movable" end, is pivotally connected to a ground engaging stabilizer pad, or "foot."

The pair of plates define an opening therebetween in which a cylinder of a fluid cylinder and piston rod assembly is pivotally trunnion mounted to the plates by a pair of cylinder pivot pins. The two cylinder pivot pins are positioned along a common axis. The piston rod is operatively connected to the stabilizer arms to move the stabilizer arm between support and transport positions and to apply a downward force to the stabilizer arm in the support position to lift the vehicle off the ground.

While a single pair of plates is preferable to mount both the stabilizer arm and the cylinder to the frame, two sets of plates could be used.

In the preferred form, the stabilizer arm has a pair of generally parallel stabilizer arm members spaced apart from each other defining a passageway therebetween through which the fluid cylinder and piston rod assembly may pass when the stabilizer arm is moved between a ground engaging support position and a generally upright transport position. Each stabilizer arm member has a fixed end pivotally connected about a stabilizer pivot point on each of the plates. The stabilizer arm members pivot about the sides of the plate that do not face each other, i.e., the forwardmost side of the forwardmost plate and the rearwardmost side of the rearwardmost plate.

The hydraulic cylinder of a cylinder and piston rod assembly is pivotally trunnion mounted about a pair of cylinder pivot pins, one cylinder pivot pin associated with each of the plates. The cylinder pivot pins are pivotally mounted onto the plates above and laterally outward of the stabilizer pivot points. The piston rod is operatively connected to the stabilizer arm near the movable end.

The movable end of the stabilizer arm, the piston rod and the ground engaging stabilizer foot are all pivotally connected about a common pivot pin in the preferred mode.

The increased moment arm permits smaller cylinders to be used with greater lift capacity than prior art end mounted cylinders. Moving the stabilizer arm pivot axis laterally outward from the frame side to accommodate the trunnion mounted cylinder has the additional benefit of increasing the outward spread of the stabilizer arm for greater lateral support of the vehicle.

Several stabilizer arm safety structures are also disclosed by the present invention. An overcenter transport structure and a latching mechanism are provided for preventing accidental dropping of the stabilizer arm during transport by reason of fluid leaks or loss of fluid pressure in the cylinder.

Other advantages and features of the present invention will be apparent from the following detailed description of a preferred embodiment of the invention, from the claims and from the accompanying drawings in which each and every detail shown is fully and completely disclosed as a part of this specification in which like numerals refer to like parts.

DETAILED DESCRIPTION

Figure 1:
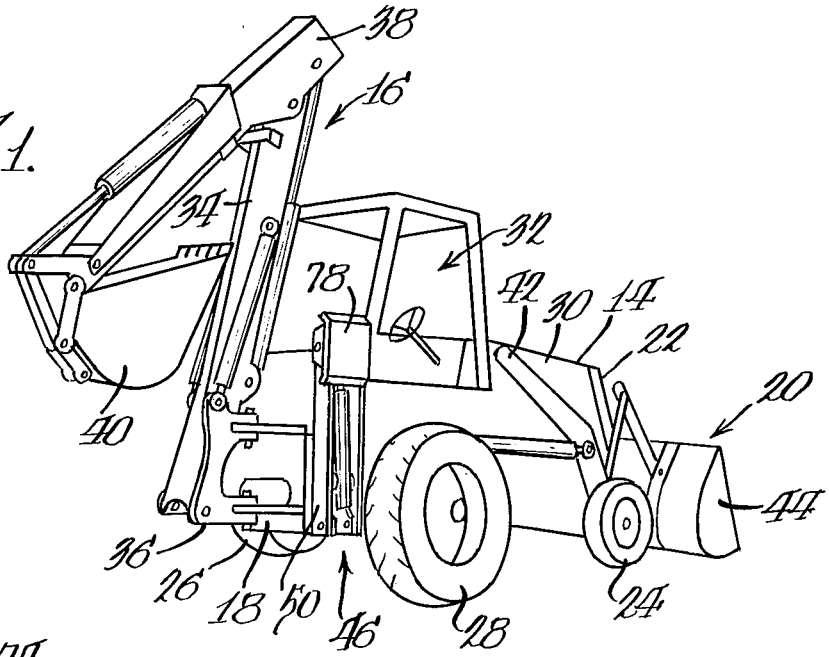
FIG. 1 is a perspective view of a wheeled construction vehicle having a stabilizer assembly constructed in accordance with principles of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 illustrates a wheeled construction vehicle 10 of the type commonly referred to as a "loader/-backhoe" or "backhoe." Vehicle 10 includes a frame or chassis 14, a backhoe unit or first material handling implement 16 operatively connected to and supported on rear end 18 of frame 14 and a loader unit or second material handling implement 20 operatively connected to and supported on front end 22 of frame 14.

A pair or set of front steering wheels 24 and rear driving wheels 26 and 28 accommodate movement of vehicle 10 and dynamically support frame 14 during movement of vehicle 10. Frame 14 has one side 30 and an opposed side (not shown) with front end 22 and rear end 18 extending laterally between and connecting one opposed side 30 to the other. An operator's compartment 32 is supported on frame 14 between opposed sides 30 and between rear end 18 and front end 22.

Backhoe unit 16 includes powered boom 34, which has its lower end pivotally mounted on cradle type swing tower 36 and has its upper end pivotally connected to dipper stick assembly 38. The outer end of dipper stick assembly 38 has bucket 40 pivotally connected thereto. Desirably, boom 34 and dipper stick assembly 38 are of substantial length so that bucket 40 can be moved a substantial distance from rear end 18 of vehicle 10. One type of backhoe unit 16 that can be used in construction vehicle 10 is shown and described in Long, U.S. Pat. No. 3,047,171.

Loader unit 20 on front end 22 of vehicle 10 generally includes a pair of elongated lift or laoder arms 42 that are pivotally supported on opposite sides 30 of frame 14 intermediate the opposite ends 18 and 22 thereof. The forward ends of arms 42 normally extend forwardly of frame 14 and a power-operated bucket 44 is pivotally connected to the outer ends of arms 42. One type of loader unit 20 that can be used with construction vehicle 10 is shown and described in Shumaker, U.S. Pat. No. 4,026,428.

In order to provide lateral stabilization for vehicle 10 and to lift rear wheels 26, 28 off the ground during operation of backhoe unit 16 a stabilizer assembly 46 is positioned generally adjacent and in proximity to, as well as rearwardly of, each of rear wheels 26 and 28. Preferably, each stabilizer assembly 46 has an elongated stabilizer arm 50 which is pivotable laterally outward of rear wheels 26 and 28 to a ground engaging and lifting position for use during operation of backhoe unit 16. In some circumstances it may be desirable to have one or more auxiliary stabilizer arms mounted adjacent the front end 22 of vehicle 10.

Figure 4:
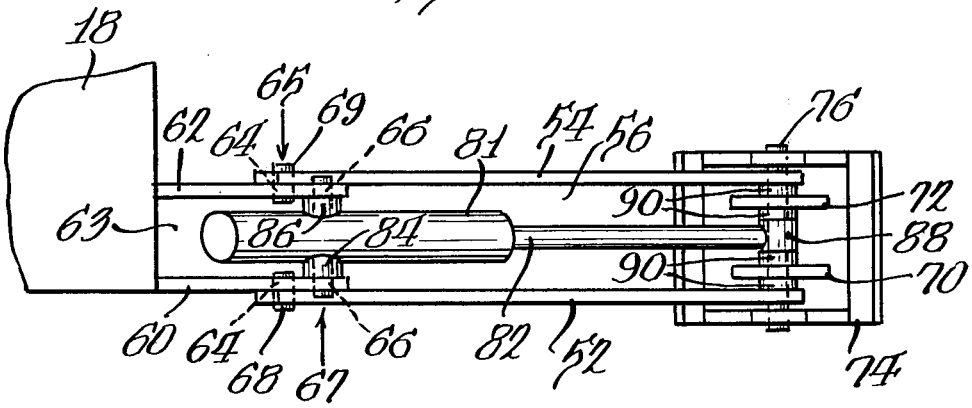
FIG. 4 is a top plan view of the stabilizer assembly taken substantially along line 4—4 of FIG. 3.

In the preferred embodiment, a stabilizer arm 50 includes a pair of stabilizer arm members 52 and 54 (FIG. 4). Desirably, stabilizer arm members 52 and 54 are generally of the same size and shape with the forwardmost or first stabilizer arm member 52 toward front end 22 of vehicle 10 and the rearwardmost or second stabilizer arm member 54 toward rear end 18 of vehicle 10.

Figure 3:
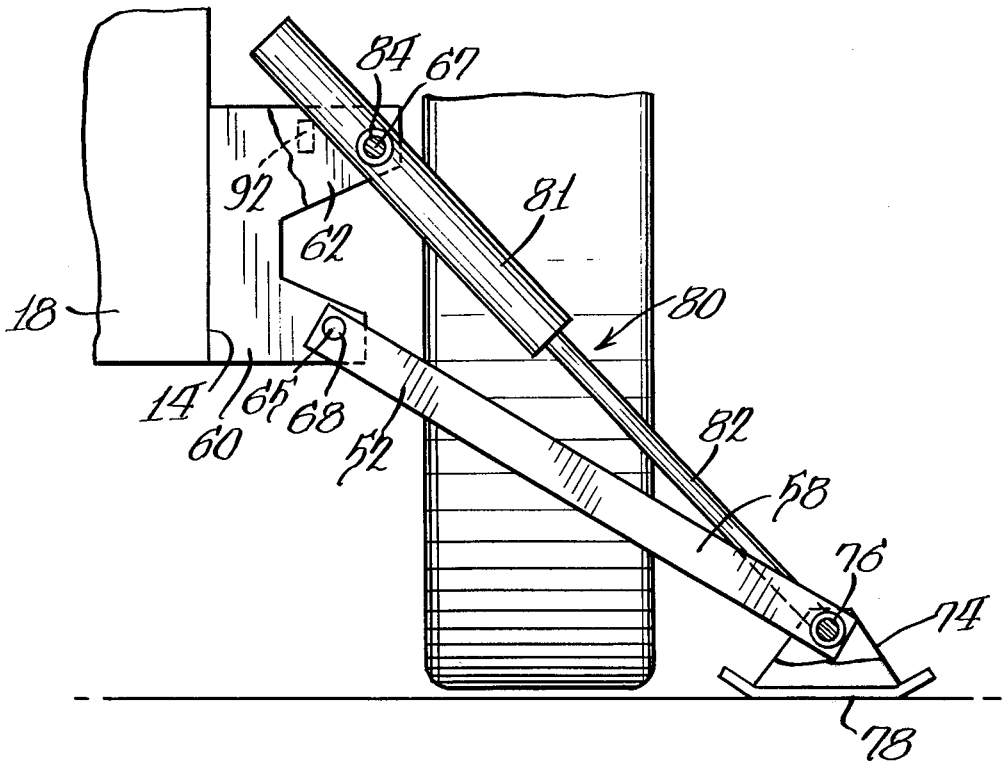
FIG. 3 is a side view of the stabilizer in a ground engaging support position.

Stabilizer arm members 52 and 54 are generally straight and are spaced apart from each other to define a passageway 56 therebetween. Passageway 56 permits passage of a fluid ram (to be described below) during pivoting of stabilizer arm members 52 and 54, and permits passage of dirt, mud, rocks and other material from the ground through passageway 56 when stabilizer arm members 52 and 54 are moved into and out of the ground engaging position. This passageway 56 prevents substantial accumulation or "caking up" of dirt, mud, etc. on stabilizer arm members 52 and 54 which might otherwise adversely affect the balance and performance of the stabilizer arms. Each stabilizer arm member 52, 54 has an elongated, generally rigid body 58 (FIG. 3). Preferably, stabilizer arm members 52 and 54 are positioned in parallel and symmetrical relationship to each other and positioned generally parallel to rear end 18 of frame 14.

As best shown in FIG. 4, a pair of vertical, parallel plates 60 and 62 are rigidly connected to side 30 of the frame 14. Plates 60 and 62 are spaced apart from each other defining opening 63. In the illustrative embodiment, each of plates 60 and 62 are ear-shaped and extend laterally outward to define bracket means. Each of plates 60 and 62 have a pair of apertures 64 and 66. Apertures 64 are aligned to define first or stabilizer pivot axis 65 and apertures 66 are aligned to define second or cylinder pivot axis 67.

The inwardly fixed end of forwardmost stabilizer arm member 52 is pivotally connected to forward plate 60 at aperture 64 about a first fixed stabilizer pivot pin 68 (FIG. 4), and the inwardly fixed end of rearwardmost stabilizer arm member 54 is pivotally connected to rearward plate 62 at aperture 64 about a second fixed stabilizer pivot pin 69. As best shown in FIG. 4, stabilizer arm members 52 and 54 pivot about the sides of plates 60 and 62 that do not face each other, i.e., stabilizer arm member 52 is adjacent the forwardmost side of forward plate 60 and stabilizer arm member 54 is adjacent the rearwardmost side of rearward plate 62. First and second stabilizer pivot pins 68 and 69 are aligned along stabilizer pivot axis 65.

The movable ends of stabilizer arm members 52 and 54 are positioned remote from fixed stabilizer pivot pins 68 and 69 and are pivotally connected to foot brackets 70 and 72 of a stabilizer foot 74 by a common pivot pin 76 at a location spaced from the fixed stabilizer pivot axis 65. In the illustrative embodiment, common pivot pin 76 supports stabilizer foot 74 which is in the form of a metal pad having a generally oblique U-shaped, outer ground engaging surface 78 as best shown in FIG. 3.

Figure 2:
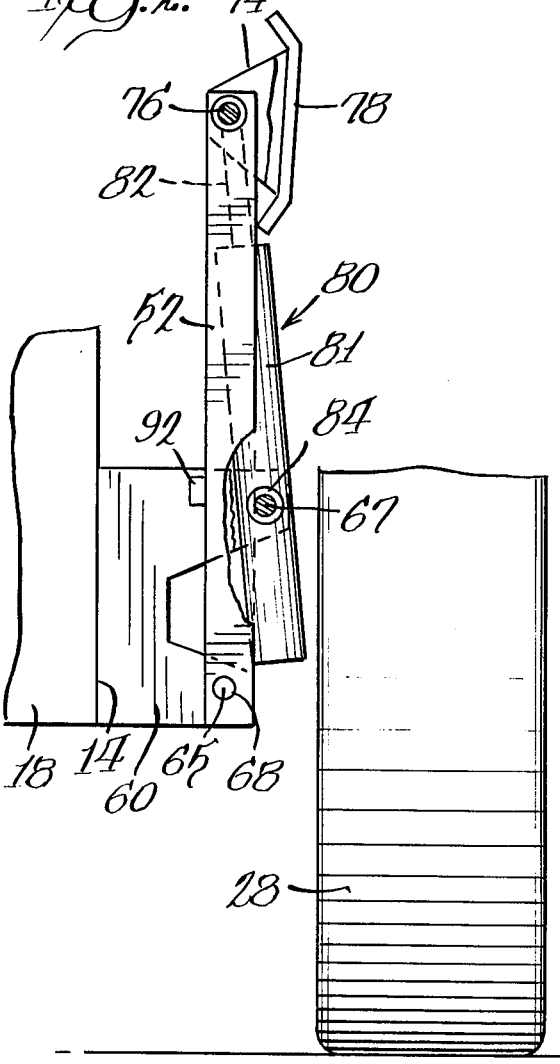
FIG. 2 is a side view of the stabilizer assembly in a generally upright overcenter transport position.

In operation, the stabilizer arm members 52 and 54 are movable from a ground-engaging position (FIG. 3) extending laterally beyond the rear wheel 28, for providing lateral stabilization and to lift vehicle 10 during operation of backhoe unit or material handling implement 16, to a generally upright transport or storage position (FIGS. 1 and 2). In order to move stabilizer arm 50 between the ground engaging position and the transport position, stabilizer arm 50 is powered by a fluid ram 80, such as a hydraulic cylinder and piston rod assembly, preferably positioned between stabilizer arm members 52 and 54 as viewed in top plan view (FIG. 4). In the illustrative embodiment, fluid ram 80 includes a hydraulic cylinder 81 and a slidable reciprocable piston rod 82 extending from one end of cylinder 81. Fluid ram 80 is expandable to the ground engaging position (FIG. 3) and retractable to the transport position (FIGS. 1 and 2). In some circumstances it may be desirable to use a pneumatic cylinder.

According to one aspect of the invention, cylinder 81 has first and second cylinder pivot pins 84 and 86 (FIG. 4) connected to an intermediate portion thereof. First cylinder pivot pin 84 is pivotally connected to forward plate 60 at aperture 66 and second cylinder pivot pin 86 is pivotally connected to rearward plate 62 at aperture 66 to trunnion mount cylinder 81 in opening 63 defined by plates 60 and 62. First and second cylinder pivot pins 84 and 86 are aligned with second or cylinder pivot axis 67 and are positioned laterally outward of and above stabilizer pivot pins 68 and 69 on plates 60 and 62.

The outer end of piston rod 82 includes an annular mounting bracket 88 (FIG. 4) which circumscribes common pivot pin 76 to pivotally connect piston rod 82 to the movable end of stabilizer arm 50. Preferably, suitable spacer sleeves 90 are telescoped on pin 76 to maintain proper spacing between stabilizer arm members 52, 54, foot brackets 70, 72 and bracket 88.

Referring to FIG. 2, stabilizer arm 50 is disposed laterally inward of cylinder pivot axis 67 in an overcenter transport position. A longitudinal fluid ram axis, defined by a plane extending between cylinder pivot axis 67 and the pivot axis of piston rod 82 is outwardly of a longitudinal axis for the stabilizer arm 50, or stabilizer arm axis, which is defined by a plane extending between the stabilizer pivot axis 65 and the pivotal connection between piston rod 82 and stabilizer arm 50.

In the operation of the stabilizer assembly so far described, retraction of fluid ram 80 will cause stabilizer arm 50 to move from the ground engaging position illustrated in FIG. 3 toward the transport position illustrated in FIG. 2. As stabilizer arm 50 approaches the upright position illustrated in FIG. 2 the stabilizer arm axis will approach and ultimately intersect cylinder pivot axis 67 at which time the moment arm for the lifting force will be zero. At this time, continued retraction of fluid ram 80 will tend to resist pivotal movement of stabilizer arm 50 to the upright position illustrated in FIG. 2. However, the momentum of the large mass of the stabilizer assembly will be sufficient to move the stabilizer arm axis across cylinder pivot axis 67. Thereafter, extension of fluid ram 80 will move stabilizer arm 50 to the fully upright position illustrated in FIG. 2, which is defined by stops 92 on plates 60 and 62.

In the fully upright transport position illustrated in FIG. 2, the stabilizer arm axis is located inwardly of cylinder pivot axis 67 and the fluid ram axis. In this position, the hydraulic fluid trapped in cylinder 81 on opposite sides of the piston on piston rod 82 acts as a hydraulic lock for locking stabilizer arm 50 in the transport position. Furthermore, if for any reason leakage should occur from the head end of the cylinder 81, the weight of fluid ram 80 will tend to maintain stabilizer arm 50 in the upright position.

The use of a trunnion mounted cylinder and the movement of the stabilizer arm overcenter with respect to the cylinder pivot axis allows the cylinder pivot axis to be moved outwardly of the stabilizer pivot axis to substantially increase the moment arm for the forces applied by the fluid ram to the stabilizer arm in the lowered position such as shown in FIG. 3. In addition, the stabilizer arm can be lengthened to obtain increased spread for the two stabilizer arms to increase the stability of the vehicle during implement operation.

The foregoing arrangement substantially increases the moment arm of the stabilizer assembly in the ground engaging support position for increased lift capacity without sacrificing any degree of transport position uprightness. The increased moment arm additionally permits the hydraulic pressure of the hydraulic cylinder to be reduced, thus lessening the need for, or eliminating entirely, hydraulic lock checks. The increased moment arm additionally permits the use of smaller fluid rams than those required in some prior art units. Greater lateral support capacity results from the increased spreading of the stabilizer arms since the pivot axis for the stabilizer arms can be moved further away from the frame.

Figure 5:
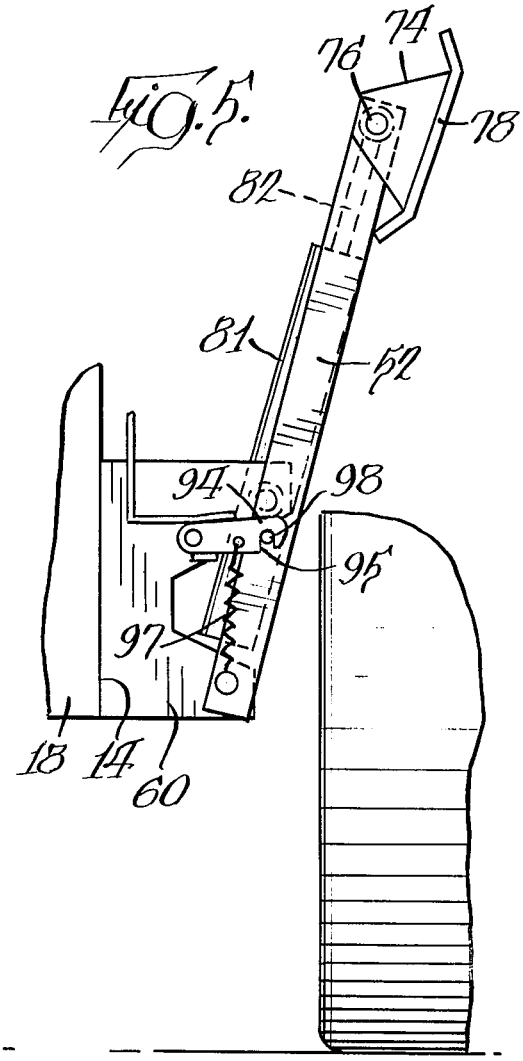
FIG. 5 is a modified form of stabilizer assembly having a non-overcenter transport position with a latching mechanism associated therewith.

A slightly modified form of the invention is illustrated in FIG. 5 wherein the greater moment arm is achieved by trunnion mounting the cylinder 81 of the stabilizer assembly. In this embodiment of the invention, the assembly is designed so that the stabilizer arm axis will not pass across the cylinder pivot axis 67. Such construction may in certain instances be desirable where the transverse transport position of the two stabilizer assemblies is not a critical factor in machine design. In this embodiment of the invention, the stabilizer arm 50 is maintained in a transport position by a simple latching mechanism which can be incorporated into the assembly at minimum cost.

Referring to FIG. 5, the stabilizer assembly is substantially identical to that described above except that stops 92 have been moved outwardly so that the stabilizer arm axis remains on one side of cylinder pivot axis 67 at all times. In this embodiment, a latching mechanism for locking the stabilizer arm 50 in a transport position is provided to eliminate reliance upon fluid pressure or the weight of the fluid ram 80 to maintain the stabilizer arm 50 in its generally upright position during transport. A latch or lug 94 having a recess 95 is pivotally mounted to plate 60 about a latch pivot point 96. The latch 94 is biased downwardly by spring means 97 attached to plate 60. A locking pin 98 mounted on stabilizer arm 50 engages latch 94 as stabilizer arm 50 is raised and drives latch 94 in an opposed biased direction, i.e., upwardly. When recess 95 is exposed to locking pin 98, the spring means 97 causes latch 94 to move downwardly and engulf locking pin 98 in recess 95, thereby locking stabilizer arm 50. A lever or cable 99 is attached to latch 94 and is controllable from the oprator's compartment 32 to open latch 94 to allow stabilizer arm 50 to be lowered.

While the foregoing description of a construction vehicle employing the present invention has only described a single stabilizer assembly unit, it is to be understood that generally vehicles use two or more stabilizer assemblies of the type described. Furthermore, while the stabilizer assembly is particularly useful with backhoes, it may also be advantageously used with many other types of vehicle.

I claim:

1. A stabilizer assembly for a vehicle having a frame comprising:

bracket means including a pair of spaced apart plates rigidly secured to and extending laterally outward from said frame, said plates defining an opening therebetween, and each plate having apertures defining first and second pivot axes extending across said opening;

a stabilizer arm having a fixed end pivoted on said first pivot axis for movement between a ground engaging support position and a generally upright transport position, and a movable end opposite said fixed end;

fluid ram means having pivot pins extending outwardly in opposite directions from an intermediate portion of said fluid ram means and received into said apertures defining said second pivot axis, so that said fluid ram means is pivotally trunnion mounted in said opening, said fluid ram means also having a free end; and connection means operatively connecting a free end of said fluid ram means to said movable end of said stabilizer arm for moving said stabilizer arm between said support and transport positions.

2. A stabilizer assembly as claim in claim 1 wherein said second pivot axis is disposed laterally outward and above said first pivot axis, and a longitudinal axis for said stabilizer arm is located between said frame and said second pivot axis and between said frame and a longitudinal fluid ram axis in said transport position.

3. A stabilizer assembly as claimed in claim 1 wherein said fluid ram means comprises:

a hydraulic cylinder and piston rod assembly, said hydraulic cylinder having said pivot pins and being trunnion mounted in said opening, and said piston rod having said free end operatively connected to said stabilizer arm.

4. A stabilizer assembly as claimed in claim 1 wherein:

said stabilizer arm comprises a pair of stabilizer arm members spaced apart from each other defining a passageway therebetween through which said fluid ram means passes when said stabilizer arm moves between said support and transport positions; and said stabilizer arm members being pivotally mounted to said bracket means about said apertures of said first pivot axis.

5. A stabilizer assembly as claimed in claim 1 further comprising stop means mounted on said bracket means for restraining movement of said stabilizer arm inward toward the frame when said stabilizer arm is being raised to said transport position.

6. A stabilizer assembly as claimed in claim 1 further comprising:

an operator's compartment on said frame;

latch means for locking said stabilizer arm in said transport position pivotally mounted to said bracket means, said latch means having a recess;

biasing means normally maintaining said latch means in a first position;

a locking pin secured to said stabilizer arm and aligned with said latch means so that movement of said stabilizer arm to said transport position will produce engagement between said latch means and said locking pin to pivot said latch means from said first position and said biasing means will return said latch means to said first position when said recess is aligned with said locking pin to move said recess into locking engagement with said locking pin; and lever means extending from said latch means to said operator's compartment for releasing said latch means.

7. A construction vehicle comprising:

a frame having opposed sides and a front end and a rear end extending laterally between and connecting said sides;

a pair of front wheels and a pair of rear wheels for accommodating movement of said vehicle and for dynamically supporting said frame during movement of said vehicle;

a material handling implement operatively connected to said rear end;

bracket means including a pair of spaced apart plates rigidly secured to and extending laterally outward from said frame on each of said opposed sides adjacent to said rear wheels, said plates defining an outwardly directed opening therebetween, each of said plates having apertures defining a lower pivot axis extending across a lower portion of said opening and an upper pivot axis extending across said opening outwardly of said lower pivot axis;

a stabilizer arm associated with each of said plates, said stabilizer arm comprising a pair of stabilizer arm members spaced apart from each other and having a fixed end pivotally mounted about said lower pivot axis on opposite sides of said opening for movement of said stabilizer arm members between a ground engaging support position laterally outward of said wheels and a generally upright transport position, and each of said stabilizer arm members having a movable end opposite said fixed end; and a hydraulic cylinder and piston rod assembly for moving each of said stabilizer arms between said support and transport positions, each of said hydraulic cylinders having projections extending outwardly from an intermediate portion thereof and pivotally received into said apertures in said plates defining said upper pivot axis so that a portion of said cylinder is located within said opening, each of said piston rods having one end operatively connected to said movable end of a stabilizer arm so that retraction of said hydraulic cylinder and piston rod assemblies with pivot said portions of said cylinders within said openings and generally align said cylinders and piston rod assemblies within said stabilizer arm members in said transport position.

8. A construction vehicle as defined in claim 7, in which said frame has an operator's compartment between said bracket means, further comprising:

latch means pivoted on each of said bracket means and having a recess;

biasing means normally maintaining said latch means in a first position;

a locking pin secured to each stabilizer arm and aligned with said latch means so that movement of said stabilizer arms to said transport position will produce engagement between said latch means and said locking pins to pivot said latch means from said first positions, and said biasing means will return said latch means to said first positions when said recess of each latch means is aligned with a locking pin to move said recess into locking engagement with said locking pin; and lever means extending from each latch means to said operator's compartment for releasing said latch means.

9. A construction vehicle as defined in claim 7 in which a longitudinal axis for each stabilizer arm member is located between said vehicle frame and the associated upper pivot axis in said transport position.

* * * * *